US009620857B2

(12) United States Patent
Chen et al.

(10) Patent No.: US 9,620,857 B2
(45) Date of Patent: Apr. 11, 2017

(54) ANTENNA STRUCTURE AND WIRELESS COMMUNICATION DEVICE

(71) Applicant: Chiun Mai Communication Systems, Inc., New Taipei (TW)

(72) Inventors: Jin-Bo Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 81 days.

(21) Appl. No.: 14/569,999

(22) Filed: Dec. 15, 2014

(65) Prior Publication Data

US 2015/0180124 A1 Jun. 25, 2015

(30) Foreign Application Priority Data

Dec. 20, 2013 (CN) ..... 2013 1 0707368

(51) Int. Cl.

| | |
|---|---|
| ***H01Q 9/00*** | (2006.01) |
| ***H01Q 5/335*** | (2015.01) |
| ***H01Q 5/378*** | (2015.01) |
| ***H01Q 9/04*** | (2006.01) |
| ***H01Q 1/24*** | (2006.01) |

(52) U.S. Cl.

CPC ..... *H01Q 5/335* (2015.01); *H01Q 1/243* (2013.01); *H01Q 5/378* (2015.01); *H01Q 9/0442* (2013.01)

(58) Field of Classification Search

CPC ..... H01Q 1/243; H01Q 9/0442; H01Q 5/335; H01Q 5/378

USPC ..... 343/745, 702

See application file for complete search history.

(56) References Cited

U.S. PATENT DOCUMENTS

| | | | | |
|---|---|---|---|---|
| 2007/0030203 | A1* | 2/2007 | Tsai | H01Q 5/371 343/702 |
| 2008/0150812 | A1* | 6/2008 | Kanazawa | H01Q 9/0407 343/702 |
| 2009/0115671 | A1* | 5/2009 | Ishihara | H01Q 1/243 343/702 |
| 2012/0127055 | A1* | 5/2012 | Yamagajo | H01Q 1/243 343/850 |
| 2014/0361948 | A1* | 12/2014 | Tanaka | H01Q 1/38 343/861 |

* cited by examiner

*Primary Examiner* — Dieu H Duong
(74) *Attorney, Agent, or Firm* — Steven M. Reiss

(57) ABSTRACT

An antenna structure includes a main antenna, a parasitic antenna, a matching circuit and a switching circuit. The main antenna includes a feeding strip and a first radiating strip coupled to the feeding strip. The parasitic antenna includes a grounding strip and a second radiating strip coupled to the grounding strip. The second radiating strip is positioned adjacent to and apart from the first radiating strip, and further configured to electromagnetically couple to and be parasitically fed by the first radiating strip. The parasitic antenna and main antenna cooperatively generate at least one high-frequency resonate mode and a low-frequency resonate mode. The matching circuit is electronically coupled to the feeding strip. The switching circuit is electronically coupled to the matching circuit, and configured to regulate an inductance value of the matching circuit output to the feeding strip, thereby regulating a central frequency of the low-frequency resonate mode.

12 Claims, 3 Drawing Sheets

ANTENNA STRUCTURE AND WIRELESS COMMUNICATION DEVICE

FIELD

The subject matter herein generally relates to antenna structures, and particularly to a broadband antenna structure and a wireless communication device employing the broadband antenna structure.

BACKGROUND

With improvements in the integration of wireless communication systems, antennas have become increasingly important. Wide bandwidth antennas are typically used for wireless communication devices that utilize various frequency bandwidths.

BRIEF DESCRIPTION OF THE DRAWINGS

Implementations of the present technology will now be described, by way of example only, with reference to the attached figures.

DETAILED DESCRIPTION

Figure 1:
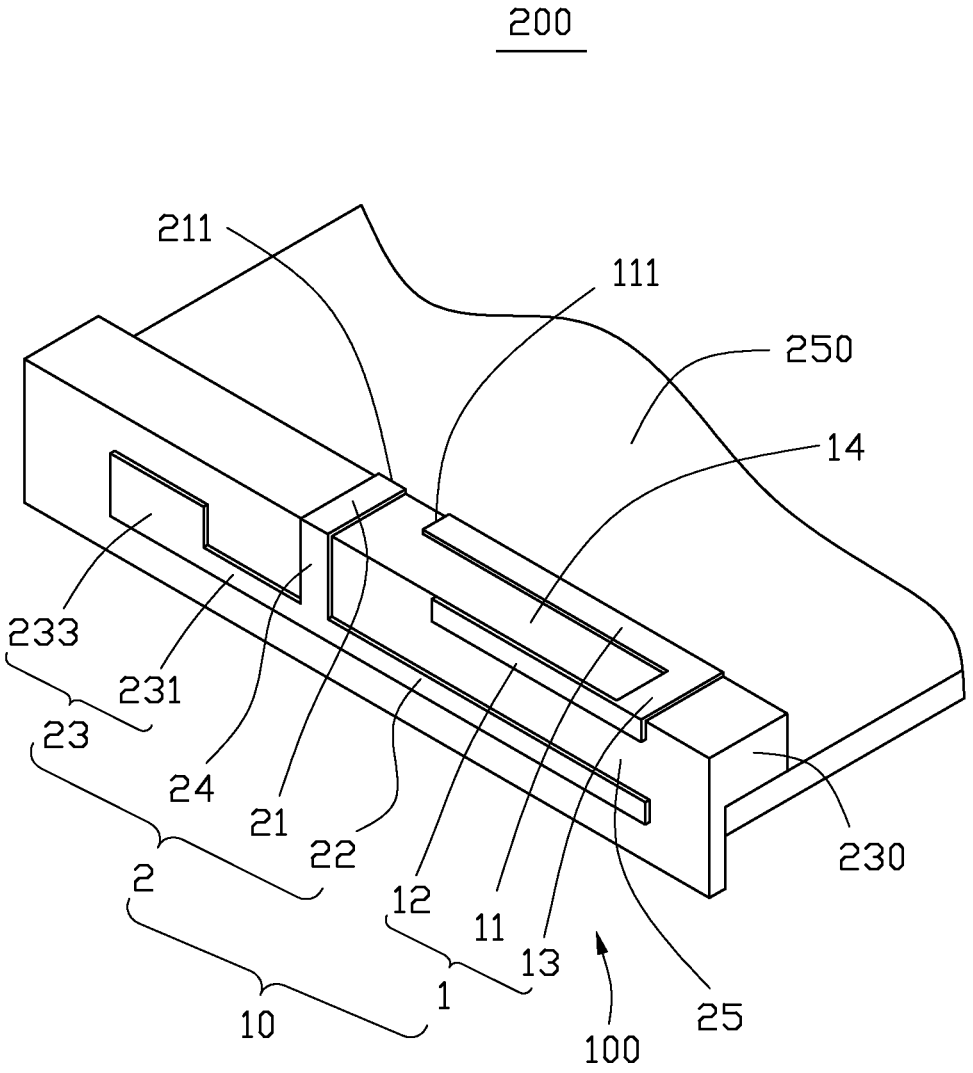
FIG. 1 illustrates an isometric view of one embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an isometric view of one embodiment of a wireless communication device 200 including an antenna structure 100, a holder 230, and a printed circuit board 250. The antenna structure 100 includes a radiation body 10. The holder 230 is positioned on the printed circuit board 250, and configured to hold the radiation body 10.

The radiation body 10 includes a main antenna 1 and a parasitic antenna 2 feeding by and resonating with the main antenna 1. The main antenna 1 includes a feeding strip 11, a first radiating strip 12, and a first connecting strip 13. The parasitic antenna 2 includes a grounding strip 21, a second radiating strip 22, a third radiating strip 23, and a second connecting strip 24.

The feeding strip 11 is a substantially rectangular strip, and has a feeding end 111. The feeding end 111 is electronically coupled to the printed circuit board 250 for feeding current signals. For example, the feeding end 111 can be electronically coupled to the printed circuit board 250 via a cable (not shown).

The first radiating strip 12 is coupled to an end of the feeding strip 11 opposite the feeding end 111 through the first connecting strip 13. The first radiating strip 12 and the feeding strip 11 are positioned at a same side of the first connecting strip 13, and are substantially perpendicular to the first connecting strip 13. A first slit 14 is defined between the first radiating strip 12 and the feeding arm 11.

The grounding strip 21 is a substantially rectangular strip, and has a grounding end 211. The grounding end 211 can be grounded via the printed circuit board 250. The grounding strip 21 is substantially perpendicular to the feeding strip 11, and is positioned adjacent to and spaced from the feeding end 111 of the feeding strip 11.

The second radiating strip 22 is a substantially rectangular strip, and is substantially parallel to and spaced from the first radiating strip 12. A second slit 25 is defined between the first and second radiating strips 12, 22.

The third radiating strip 23 continuously extends from the second radiating strip 22. The third radiating strip 23 includes a first section 231 and a second section 233 coupled to the first section 231. The first section 231 continuously extends from the second radiating strip 22. The second section 233 extends from the first section 231 away from the second radiating strip 22, and is wider than the first section 231. A junction between the second and third radiating strips 22 and 23 is coupled to the grounding strip 21 by the second connecting strip 24 that is substantially perpendicular to both the second and third radiating strips 22, 23.

In at least one embodiment, for reducing a size of the antenna structure 100, the feeding strip 11, the grounding strip 21 and the first connecting strip 13 are positioned in a first plane; the second and third radiating strips 22 and 23, and the second connecting strip 24 are positioned in a second plane that is substantially perpendicular to the first plane. In addition, the second connecting strip 24 is substantially perpendicularly coupled to the grounding strip 21.

In use, when current signals are fed to the feeding strip 11, the first radiating strip 12 can electromagnetically couple to the feeding strip 11. In addition, the second radiating strip 22 can electromagnetically couple to the first radiating strip 12 to generate parasitic current, such that the antenna structure 100 can excite a plurality of high-frequency resonate mode and a low-frequency resonate mode, to send/receive wireless signals at a high-frequency band from about 1710 MHz to about 2400 MHz. In addition, by regulating impedance matching of the radiation body 10, the central frequency of the low-frequency resonate mode can be regulated, such that the antenna structure 100 can send/receive wireless signals at a low-frequency band from about 698 MHz to about 960 MHz. Accordingly, the wireless communication device 200 employing the antenna structure 100 can be utilized in common wireless communication systems, such as LTE700/GSM850/EGSM900/DCS1800/PCS1900/UMTS/LTE2300. More detail about the regulation of the impedance matching of the radiation body 100 will be described below.

Figure 2:
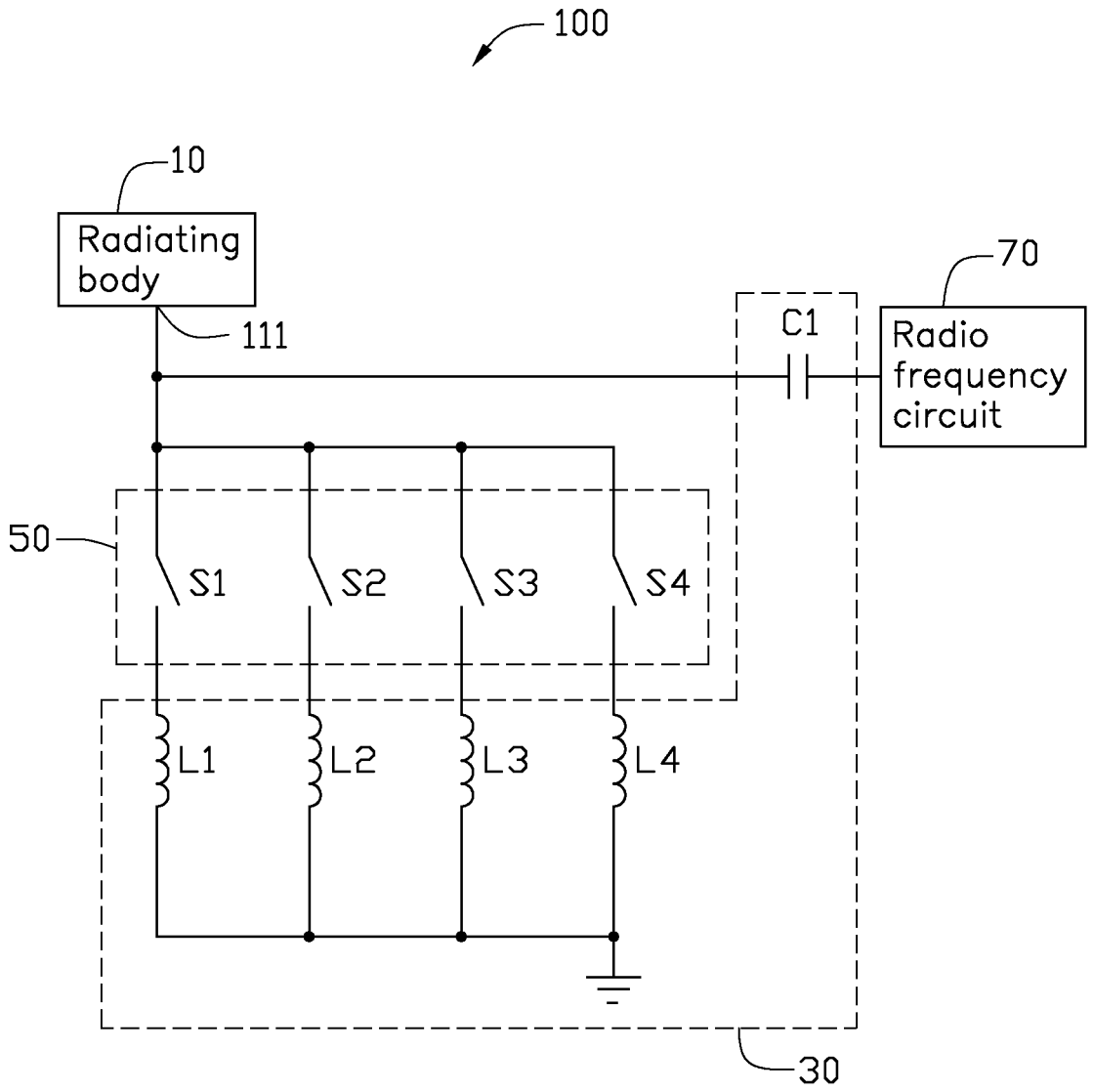
FIG. 2 illustrates a circuit diagram of the antenna structure as shown in FIG. 1.

FIG. 2 illustrates a circuit diagram of the antenna structure 100 as shown in FIG. 1. The antenna structure 100 is further provided with a matching circuit 30, a switching circuit 50, and a radio frequency circuit 70, all of which are position on the printed circuit board 250.

The matching circuit 30 includes a capacitor C1, and four inductors L1-L4 with different inductance values. The switching circuit 50 includes four switches S1-S4. The capacitor C1 is electronically coupled between the radio frequency circuit 70 and the feeding end 111 (also see FIG. 1) of the radiation body 10. The inductors L1-L4 are grounded, and are electronically coupled to a node between the feeding end 111 and the capacitor C1 through the switches S1-S4, respectively. The matching circuit 30 is configured to facilitate an impedance matching at low-frequency of the radiation body 10. By controlling the operation of the switches S1-S4, an inductance value of the matching circuit 30 electronically coupled to the feeding end 111 can be regulated, thereby regulating the central frequency of the low-frequency resonant mode of the radiation body 10.

For example, when the switches S1 and S2 are switched on, and switches S3 and S4 are switched off, the radiation body 10 generates a low-frequency mode at about 700 MHz; when the switches S1 and S3 are switched on, and the switches S2 and S4 are switched off, the radiation body 10 generates a low-frequency mode at about 850 MHz; when the switches S1 and S4 are switched on, and the switches S2 and S3 are switched off, the radiation body 10 generates a low-frequency mode at about 900 MHz. Accordingly, the low-frequency bandwidth of the radiation body 10 can be broadened by controlling the operation of the switches S1-S4.

Figure 3:
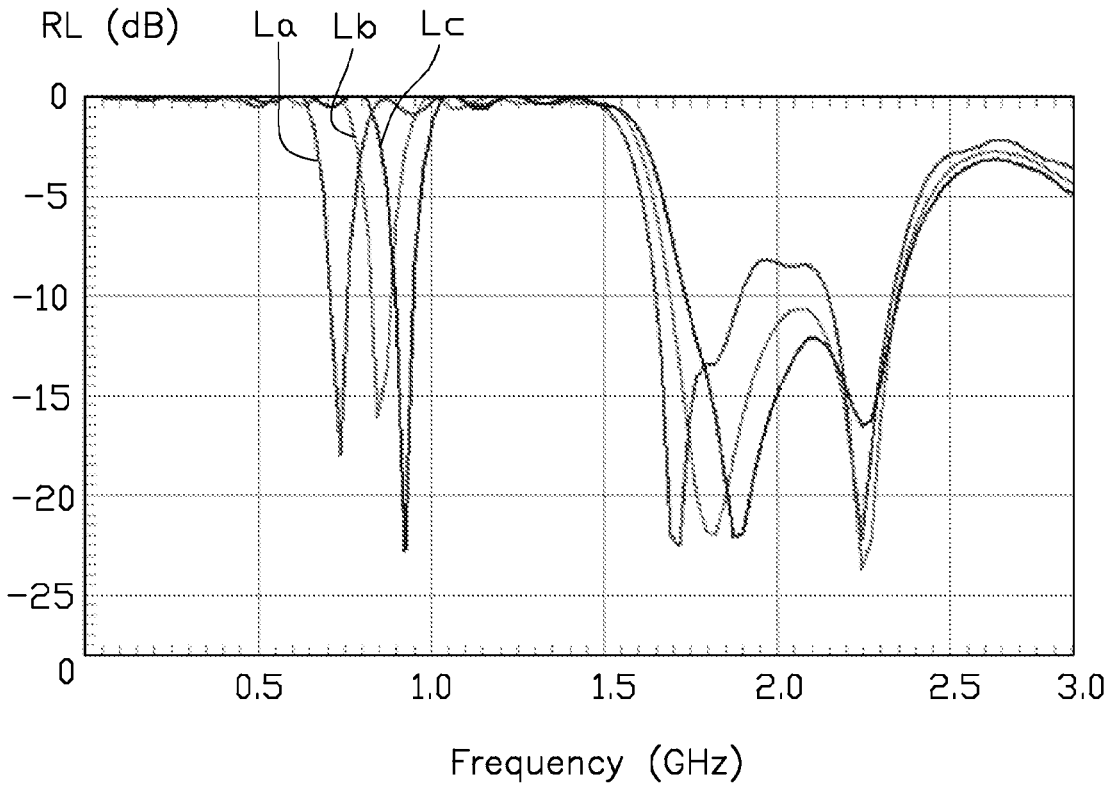
FIG. 3 illustrates a diagram showing return loss ("RL") measurements of the antenna structure as shown in FIGS. 1-2.

FIG. 3 illustrates a diagram showing return loss ("RL") measurements of the antenna structure 100 as shown in FIGS. 1-2. Curve La represents a RL measurement of the antenna structure 100 when the switches S1 and S2 are switched on, and switches S3 and S4 are switched off. Curve Lb represents a RL measurement of the antenna structure 100 when the switches S1 and S3 are switched on, and the switches S2 and S4 are switched off. Curve Lc represents a RL measurement of the antenna structure 100 when the switches S1 and S4 are switched on, and the switches S2 and S3 are switched off. It can be derived from FIG. 3 that the RL is lower than −5 dB when the antenna structure 100 operates at the low frequency band from about 698 MHz to about 960 MHz, and a high frequency band from about 1710 MHz to about 2400 MHz.

Table 1 illustrates gains measurements of the antenna structure 100 when the antenna structure 100 send/receive wireless signals at different frequencies. As illustrated in Table 1, the antenna structure 100 and the wireless communication device 200 can be utilized in common wireless communication systems, such as LTE700/GSM850/EGSM900/DCS1800/PCS1900/UMTS/LTE2300, with an exceptional communication quality.

TABLE 1

| Receiving Frequency(MHz) | Gain(dB) | Sending Frequency(MHz) | Gain(dB) |
|---|---|---|---|
| GSM 850 | −2.23 | GSM 850 | −2.69 |
| EGSM 900 | −2.81 | EGSM 900 | −3.56 |
| DCS 1800 | −1.74 | DCS 1800 | −1.77 |
| PCS 1900 | −1.34 | PCS 1900 | −1.48 |
| UMTS 2100 | −1.78 | UMTS 2100 | −1.56 |
| LTE 700 | −3.28 | LTE 700 | −2.29 |
| LTE 2300 | −2.13 | LTE 2300 | −2.13 |

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a main antenna comprising a feeding strip, a first radiating strip coupled to the feeding strip, and a first connecting strip coupled between the feeding strip and the first radiating strip;

a parasitic antenna comprising a grounding strip, a second radiating strip coupled to the grounding strip, a second connecting strip, and a third radiating strip; the grounding strip positioned in a first plane, the second radiating strip positioned in a second plane substantially perpendicular to the first plane, the second connecting strip positioned coplanar with the second radiating strip and coupled between the second radiating strip and the grounding strip, the third radiating strip positioned coplanar with the second radiating strip, continuously extending from the second radiating strip, and coupled to a junction between the second radiating strip and the second connecting strip; the second radiating strip positioned adjacent to and apart from the first radiating strip, the second radiating strip configured to electromagnetically couple to and be parasitically fed by the first radiating strip; wherein the third radiating strip comprises a first section and a second section, the first section continuously extends from the second radiating strip; the second section is perpendicularly connected to one end of the first section away from the second radiating strip and extends along a direction away from the second radiating strip and towards the second connecting strip;

the parasitic antenna and main antenna cooperatively generating at least one high-frequency resonate mode and a low-frequency resonate mode;

a matching circuit electronically coupled to the feeding strip; and a switching circuit electronically coupled to the matching circuit, and configured to regulate an inductance value of the matching circuit output to the feeding strip, thereby regulating a central frequency of the low-frequency resonate mode.

2. The antenna structure of claim 1, wherein the feeding strip and first radiating strip are substantially perpendicular to the first connecting strip and are positioned at a same side of the first connecting strip.

3. The antenna structure of claim 1, wherein the feeding strip and the first connecting strip are positioned in the first plane, the first radiating strip is positioned in the second plane.

4. The antenna structure of claim 1, wherein the second connecting strip is substantially perpendicular to the second radiating strip.

5. The antenna structure of claim 1, wherein the second section is positioned parallel with the second connecting strip, and the second section is wider than the first section.

6. The antenna structure of claim 1, further comprising a radio frequency circuit, wherein the matching circuit comprises a capacitor and at least two inductors, the switching circuit comprises at least two switches; the capacitor is electronically coupled between the feeding strip and the radio frequency circuit; the at least two inductors are electronically coupled to the at least two switches respectively; the at least two switches are configured to electronically couple the at least two inductors to the feeding strip.

7. A wireless communication device comprising:

a printed circuit board; and an antenna structure comprising:

a main antenna comprising a feeding strip, a first radiating strip coupled to the feeding strip, and a first connecting strip coupled between the feeding strip and the first radiating strip;

a parasitic antenna comprising a grounding strip, a second radiating strip coupled to the grounding strip, a second connecting strip, and a third radiating strip; the grounding strip positioned in a first plane, the second radiating strip positioned in a second plane substantially perpendicular to the first plane, the second connecting strip positioned coplanar with the second radiating strip and coupled between the second radiating strip and the grounding strip, the third radiating strip positioned coplanar with the second radiating strip, continuously extending from the second radiating strip, and coupled to a junction between the second radiating strip and the second connecting strip; the second radiating strip positioned adjacent to and apart from the first radiating strip, the second radiating strip configured to electromagnetically couple to and be parasitically fed by the first radiating strip; wherein the third radiating strip comprises a first section and a second section, the first section continuously extends from the second radiating strip; the second section is perpendicularly connected to one end of the first section away from the second radiating strip and extends along a direction away from the second radiating strip and towards the second connecting strip;

the parasitic antenna and main antenna cooperatively generating at least one high-frequency resonate mode and a low-frequency resonate mode;

a matching circuit positioned on the printed circuit board and electronically coupled to the feeding strip; and a switching circuit positioned on the printed circuit board electronically coupled to the matching circuit, and configured to regulate an inductance value of the matching circuit output to the feeding strip, thereby regulating a central frequency of the low-frequency resonate mode.

8. The wireless communication device of claim 7, wherein the feeding strip and first radiating strip are substantially perpendicular to the first connecting strip and are positioned at a same side of the first connecting strip.

9. The wireless communication device of claim 7, wherein the feeding strip and the first connecting strip are positioned in the first plane, the first radiating strip is positioned in the second plane.

10. The wireless communication device of claim 7, wherein the second connecting strip is substantially perpendicular to the second radiating strip.

11. The wireless communication device of claim 7, wherein the second section is positioned parallel with the second connecting strip, and the second section is wider than the first section.

12. The wireless communication device of claim 7, further comprising a radio frequency circuit, wherein the matching circuit comprises a capacitor and at least two inductors, the switching circuit comprises at least two switches; the capacitor is electronically coupled between the feeding strip and the radio frequency circuit; the at least two inductors are electronically coupled to the at least two switches respectively; the at least two switches are configured to electronically couple the at least two inductors to the feeding strip.

* * * * *